US010136740B2

(12) United States Patent
Goppion

(10) Patent No.: US 10,136,740 B2
(45) Date of Patent: Nov. 27, 2018

(54) SHOWCASE WITH SLIDING AND COMPRESSION CLOSURE

(71) Applicant: GOPPION S.P.A., Trezzano sul Naviglio (MI) (IT)

(72) Inventor: Alessandro Goppion, Milan (IT)

(73) Assignee: GOPPION S.P.A., Trezzano sul Naviglio (MI) (IT)

( * ) Notice: Subject to any disclaimer, the term of this patent is extended or adjusted under 35 U.S.C. 154(b) by 0 days.

(21) Appl. No.: 15/113,794

(22) PCT Filed: Jan. 26, 2015

(86) PCT No.: PCT/IB2015/050563
§ 371 (c)(1),
(2) Date: Jul. 22, 2016

(87) PCT Pub. No.: WO2015/111009
PCT Pub. Date: Jul. 30, 2015

(65) Prior Publication Data

US 2016/0331153 A1 Nov. 17, 2016

(30) Foreign Application Priority Data

Jan. 27, 2014 (IT) ..... MI2014A0105

(51) Int. Cl.
*A47F 3/00* (2006.01)
*A47F 3/12* (2006.01)
(Continued)

(52) U.S. Cl.
CPC ..... *A47F 3/125* (2013.01); *A47F 3/002* (2013.01); *A47F 3/005* (2013.01); *E05F 15/638* (2015.01);
(Continued)

(58) Field of Classification Search
CPC ..... A47F 3/005
(Continued)

(56) References Cited

U.S. PATENT DOCUMENTS 5,069,512 A * 12/1991 Sykes ..... A47F 3/005 248/205.3
6,152,549 A * 11/2000 Goto ..... A47B 81/06 312/139.2
(Continued)

FOREIGN PATENT DOCUMENTS

DE 20 2009 004 802 U1 9/2010
EP 2 202 374 A2 6/2010

OTHER PUBLICATIONS

International Search Report for PCT/IB2015/050563, date of completion Apr. 14, 2015, dated Apr. 22, 2015.
(Continued)

*Primary Examiner* — Matthew W Ing
(74) *Attorney, Agent, or Firm* — Steinfl + Bruno LLP

(57) ABSTRACT

A showcase includes a fixed case, an openable sliding door, closable on the fixed case, a compression sealing gasket, between the fixed case and the openable door, an upper guide and a lower guide mounted on the fixed case. The openable door is slidably mounted on the upper and lower guides, and both the upper guide and the lower guide are movable between respective extracted positions and respective retracted positions with respect to the fixed case. The showcase also includes lower actuation means, and upper actuation means. The upper actuation means are operatively connected to the lower actuation means and/or to the lower guide.

16 Claims, 13 Drawing Sheets

(51) Int. Cl.
*E05F 15/638* (2015.01)
*E05D 15/10* (2006.01)

(52) U.S. Cl.
CPC ..... *E05D 15/1005* (2013.01); *E05Y 2201/62* (2013.01); *E05Y 2900/204* (2013.01)

(58) Field of Classification Search
USPC ..... 312/114, 138.1, 139, 139.2
See application file for complete search history.

(56) References Cited

U.S. PATENT DOCUMENTS

| | | | | |
|---|---|---|---|---|
| 6,655,760 | B1 * | 12/2003 | Sakata | A47F 3/043 312/116 |
| 6,793,298 | B2 * | 9/2004 | Delph | A47B 96/00 312/139.2 |
| 2008/0191592 | A1 * | 8/2008 | Dubach | E05B 65/46 312/319.1 |
| 2011/0095670 | A1 * | 4/2011 | Cho | F25D 25/025 312/405.1 |
| 2012/0001441 | A1 * | 1/2012 | Juan | A47B 88/463 292/164 |

OTHER PUBLICATIONS

Written Opinion for PCT/IB2015/050563, date of completion Apr. 14, 2015, dated Apr. 22, 2015.

* cited by examiner

SHOWCASE WITH SLIDING AND COMPRESSION CLOSURE

CROSS-REFERENCE TO RELATED APPLICATIONS

The present application is the U.S. national stage of International Patent Application PCT/IB2015/050563 filed on Jan. 26, 2015 which, in turn, claims priority to Italian application MI2014A000105 filed on Jan. 27, 2014.

The present invention refers to a showcase for storage and display of objects, such as typically works of art, objects of cultural heritage or in any case delicate objects, in museums, exhibitions and the like.

In particular, the showcase can simply enclose the works, preventing people or things from making contact with them, or it can be such as to ensure the storage of the works in a protected environment; here and hereafter, protected environment means an environment in which the atmosphere is controlled, through monitoring of one or more parameters from temperature, humidity, dust content, pollutant content, in order to maintain the foreseen storage conditions of the objects on display, and in which unauthorised people are prevented from being able to gain access to them, in order to avoid theft or damage to the objects on display.

Showcases of this type must therefore satisfy various kinds of requirements, in relation to the storage and integrity of the objects displayed. Moreover, of course, these showcases must ensure maximum visibility of the objects displayed.

In order to improve visibility, manufacturers of showcases try as hard as they can to use transparent materials—typically glass—for the walls of the showcase. As well as ensuring maximum visibility of the objects displayed, the extensive use of glass is often desired by designers of showcases because the transparency of the material allows the objects displayed to be given maximum visual impact. This material does, however, involve a very high weight, which can create difficulties in the movement of the openable door.

Moreover, in order to facilitate the insertion and removal of the objects displayed, it is common to use sliding doors, in which opening takes place by sliding an openable door that in practice forms an entire wall.

In order to ensure better separation between the protected inside and the external environment, it is common to use compression sealing gaskets, i.e. elastic gaskets that are compressed during the closing of the showcase, so that their elasticity exerts a thrust between a fixed case of the showcase and the openable door, so as to ensure the desired level of seal.

The use of compression sealing gaskets in showcases with sliding doors requires that the openable door be mounted on the fixed case of the showcase so as to have a dual possibility of movement: a sliding movement, substantially in a direction parallel to the plane of the door itself, so as to allow the showcase to be opened; and an approach movement, substantially perpendicular to the sliding movement, so as to allow the compression of the gasket during closing and the expansion of the gasket and its substantial disengagement from the case or from the door during opening, so as not to hinder the sliding of the door. In these showcases, the openable door thus takes up three operating positions: door closed, in which the door is brought next to the fixed case of the showcase, so as to ensure the sealed closure of the showcase; door open and semi-shut, in which the door is in front of the case but more or less away from it, so as to end the compression of the gasket and thus the seal of the showcase; door open and distanced, in which the door is distanced from the fixed case, so as to allow free access to the inside of the showcase.

When the openable door is made from glass and is large in size, particularly in the height direction (i.e. with heights of 2 meters and above), for reasons of constructive simplifications and ease of operation, it is considered sufficient for the disengagement of the gasket to be obtained with an approach movement only at the lower side of the door. Indeed, showcases are known in which the door is able to slide on two guides, a lower one and an upper one; the lower guide is mounted so as to be movable towards/away from the fixed case of the showcase, whereas the upper guide is fixed. In these showcases, it is accepted for the sealing gasket—at the upper side of the door—to remain in some way compressed also during the sliding of the door. The position of the upper guide must be carefully set, so that the gasket is compressed enough to be able to provide the necessary seal with the door closed, but not enough to prevent the sliding with the door open; indeed, given the type of movement of the door, the compression of the gasket at the upper side of the door does not vary much between the condition of the door closed and the condition of the door distanced. A certain variation of the compression of the gasket can be obtained by positioning the upper guide distanced towards the top with respect to the gasket, so that the distancing at the lower side of the door also results in a certain distancing at the upper side. In the case in which it is necessary to ensure a particularly strong seal, however, this solution may not be suitable, because the residual compression present on the gasket with the door distanced can still be such as to seriously hinder the sliding from the position with the door distanced to the position with the door open and vice versa. In these cases, it is inevitable to provide for the openable door to move away from the fixed case also at the upper side of the showcase; this means that those in charge of opening/closing the showcase also have to access the upper side of the openable door, in order to be able to actuate mechanisms for moving the upper guide towards/away from the fixed case of the showcase.

Particularly in the closing step, staff must be able to exert even great forces, necessary to suitably compress the gasket; although this is relatively easy at the lower side of the openable door (i.e. more or less at ground level), it can present difficulties at the upper side of the openable door when it is large in size, because in this case access must take place through a ladder, platform or similar.

There is thus the problem of making showcases with sliding doors, even of large size, in which it is possible to ensure a strong seal without this making the opening and closing operations complicated.

Consequently, the present invention concerns a showcase as defined in claim 1. Preferred characteristics are indicated in the dependent claims.

In particular, the showcase comprises:

- a fixed case,
- an openable sliding door, closable on the fixed case,
- a compression sealing gasket, between the fixed case and the openable door,
- an upper guide and a lower guide mounted on the fixed case, where the openable door is slidably mounted on the upper and lower guides, and both the upper guide and the lower guide are movable between respective extracted positions and respective retracted positions with respect to the fixed case, lower actuation means, adapted to move the lower guide from the extracted position to the retracted position and vice versa, upper actuation means, adapted to move la upper guide from the extracted position to the retracted position and vice versa, in which the upper actuation means can be actuated without accessing the upper area of the showcase.

In this way, it is possible to open and close the openable door of the showcase by acting only from the bottom, without it being necessary to access the upper guide with ladders, platforms or the like.

In a preferred embodiment, the upper actuation means comprise at least one actuation group comprising:

a rack, slidably mounted on the case along an upper side thereof, an arm hinged to the case through a pin orthogonal to the rack, a toothed section, formed on the arm about the pin and meshed with the rack, an end of the arm, remote with respect to the toothed section, hinged to an arm integral with the upper guide.

In this way, the movement of the upper guide between its extracted and retracted positions is obtained by the sliding of the rack on the case of the showcase; this is a particularly robust and precise actuation, capable of ensuring excellent operation even in the case in which it is necessary to apply high forces to the upper guide during closing, to suitably compress a gasket adapted for a very strong seal. The number of actuation groups of the upper actuation means depends on the width of the openable door; for narrow doors, one or two groups may be sufficient, whereas for wide doors it is preferable to have many groups, with the respective racks arranged in series one after the other, so as to always be moved in total synchrony; it is also possible for many actuation groups to share a single rack. Hereafter, for the sake of simplicity of presentation, reference will be made to just one actuation group, therefore of a single rack; what is stated with reference to the single rack obviously applies for a succession of racks arranged in series and connected to one another, or a rack shared by many actuation groups.

Preferably, the upper actuation means are operatively connected to the lower actuation means and/or to the lower guide, so as to move the upper guide into its extracted position when the lower guide is moved into its extracted position and to move the upper guide into its retracted position when the lower guide is moved into its retracted position.

In this way, it is possible to open and close the openable door of the showcase by only acting on the lower guide, without it being necessary to access the upper guide, which is moved by the movement of the lower guide thanks to the connection of the upper actuation means to the lower actuation means and/or to the lower guide. It is possible to obtain a very strong seal, i.e. with strong compression of the gasket, without this preventing or in any case hindering the possibility of sliding of the door, since it is possible to freely choose the amount of compression of the gasket when the door is closed.

The lower actuation means can be of any type, either manual or motorised, according to the specific requirements.

Preferably, the upper actuation means are operatively connected to the lower actuation means and/or to the lower guide through a mechanical transmission. Advantageously, a mechanical transmission allows even very high forces to be transmitted, still ensuring high precision and reliability. In alternative embodiments of the invention, the connection of the upper actuation means to the lower actuation means can be made with an electrical connection, between electrical upper actuation means and suitable movement sensors of the lower displacement means.

Preferably, the mechanical transmission comprises a first cable, connected between the lower actuation means and the rack of the upper actuation means, adapted to pull the rack in a first direction. A cable system is advantageous due to its structural simplicity combined with a very high ability to support traction loads.

Of course, a single cable is able to apply only traction forces, i.e. it allows the upper guide to only be actuated in one direction, opening or closing. For example, with a single cable it is possible to obtain the actuation in the closing direction of the door (i.e. with the upper guide passing from the extracted position to the retracted position), because in this direction the mechanical loads can be very high, leaving the actuation in the opposite direction to be carried out through springs or similar elastic return means, more suitable for smaller loads.

Preferably, however, the mechanical transmission comprises a second cable, connected between the lower actuation means and the rack of the upper actuation means, opposite the first cable, adapted to pull the rack in a second direction opposite the first direction. In this way, the actuation of the rack in both directions is obtained by means of a cable, thus ensuring the maximum safety of actuation in both directions.

Preferably, the mechanical transmission comprises a plurality of return means for the first and for the second cable, in which the arrangement of the return means is such that:

when the lower guide is moved from the retracted position to the extracted position, the first cable pulls the rack making it translate in the first direction, moving the arm so as to move the upper guide from the retracted position to the extracted position, whereas the second cable does not pull the rack in the second direction but follows the displacement thereof in the first direction;

when the lower guide is moved from the extracted position to the retracted position, the second cable pulls the rack making it translate in the second direction, moving the arm so as to move the upper guide from the extracted position to the retracted position, whereas the first cable does not pull the rack in the first direction but follows the displacement thereof in the second direction.

In this way, while one cable is under tension to force the rack, and consequently the upper guide, to move, the other cable—not under tension—is in practice recovered, preventing it from being arranged in positions that can then jeopardise its correct movement when it is necessary to make the rack move in the opposite direction.

This "coordinated" actuation of the two cables can be obtained in various ways. Preferably:

the first cable is anchored to the lower guide and the return means on which the first cable passes comprise a first initial return means hinged on a bracket integral with the case and a plurality of first successive return means hinged on the case;

the second cable is anchored to the lower guide and the return means on which the second cable passes comprise a second initial return means hinged on a bracket integral with the lower guide and a plurality of second successive return means hinged on the case.

This simple provision ensures that every movement of the lower guide pulls one of the two cables for a certain length and leaves the other of the two cables free for the same length.

In a preferred embodiment:

- the first cable passes in a first hoist, said first hoist comprising a fixed body and a movable body, where
  - the fixed body is fixed on the case,
  - the movable body is fixed to the rack and is slidably guided on the case together with the rack, and
  - on the fixed and movable bodies two respective series of pulleys are rotatably mounted, on which the first cable passes;
- the second cable passes in a second hoist, said second hoist comprising a fixed body and a movable body, where
  - the fixed body is fixed on the case,
  - the movable body is fixed to the rack and is slidably guided on the case together with the rack, and
  - on the fixed and movable bodies two respective series of pulleys are rotatably mounted, on which the second cable passes;

wherein the first and the second hoists have the same number of pulleys so as to obtain the same ratio.

Particularly in the case in which it is suitable to compress the gasket with a very high force (for example for showcases where a strong seal is needed, because the conditions to be maintained inside are very different from those of the external environment), the use of hoists makes it advantageously possible to easily multiply the force applied on the cable at its end anchored to the lower guide. Of course, due to the very nature of the hoist, this multiplication of force applied corresponds to an equal reduction in movement: if for example a hoist with five pulleys is used, the force is quintupled and the movement is reduced to one fifth. As a result the movement of the upper guide will be a fraction of that of the lower guide; of course, it will be necessary to ensure that the movement of the upper guide is still sufficient to allow easy sliding of the door.

Preferably, the ratio of the first and second hoist is comprised between 1:2 and 1:8, i.e. the force transmitted by the hoists is multiplied by a factor of between 2 and 8, whereas the movement is reduced to ½-⅛. These values are suitable for ensuring the desired type of operation, in any type of showcase.

Preferably, the fastening between the rack and the movable bodies of the first and second hoist is adjustable. This allows easy adjustment of the extreme positions of the rack and thus of the upper guide, i.e. the extracted position and the retracted position.

Preferably, the anchoring between the first cable and the lower guide and the anchoring between the second cable and the lower guide are adjustable. This possibility of adjustment also facilitates the preparation of the showcase.

In a preferred embodiment, the mechanical transmission comprises:

- a slidable body associated with the rack,
- a tie-rod, with a threaded traction portion engaged in a corresponding threaded cavity of the slidable body and a control portion provided with a wheel, fastened integral in rotation with the tie-rod,
- a motor axis, adjacent to the wheel,
- a screw-nut coupling between the motor axis and the wheel.

This mechanical transmission makes it possible to control the rack in an irreversible manner; the screw-nut coupling, indeed, allows the motion to be transferred from the screw (motor axis) to the nut (wheel) but not vice versa. Thanks to this characteristic any accidental movement of the rack is thus safely prevented. Moreover, the transmission ratio between screw and nut makes it possible to directly obtain the necessary reduction in motion, without using hoists or other mechanical reductions.

In a preferred embodiment, the motor axis extends vertically in the showcase and is accessible by external driving means, in a lower area of the showcase. Alternatively, the motor axis extends vertically in the showcase and is set in rotation by the lower actuation means.

Preferably, the fastening between the rack and the slidable body is adjustable. This allows easy adjustment of the extreme positions of the rack and therefore of the upper guide, i.e. the extracted position and the retracted position.

Further characteristics and advantages of the invention will become clearer from the following description of preferred embodiments of a showcase according to the invention, made with reference to the attached drawings. In such drawings.

Figure 2:
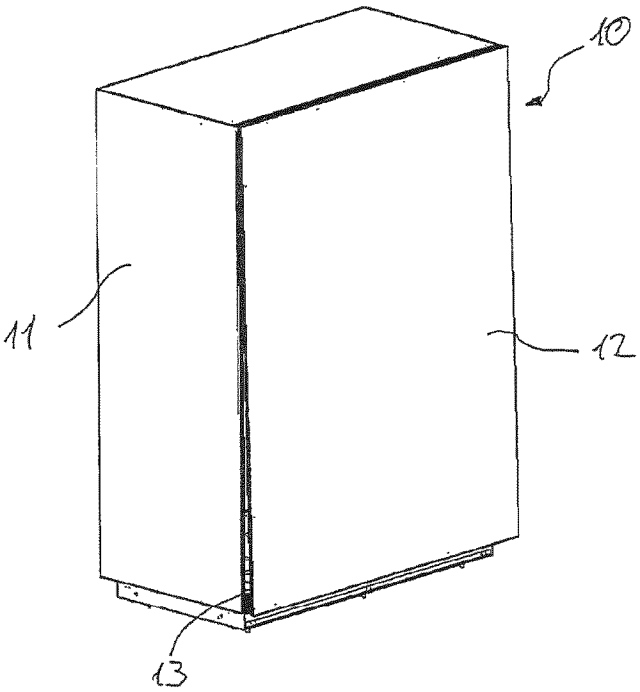
FIGS. 1, 2 and 3 are overall schematic views of a showcase according to the invention, respectively in the condition with the openable door closed, semi-shut and open.
Figure 1:
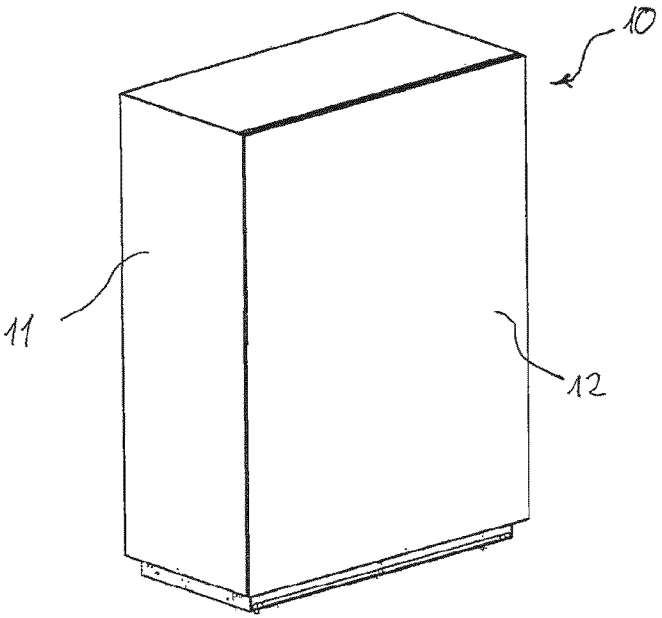
Figure 3:
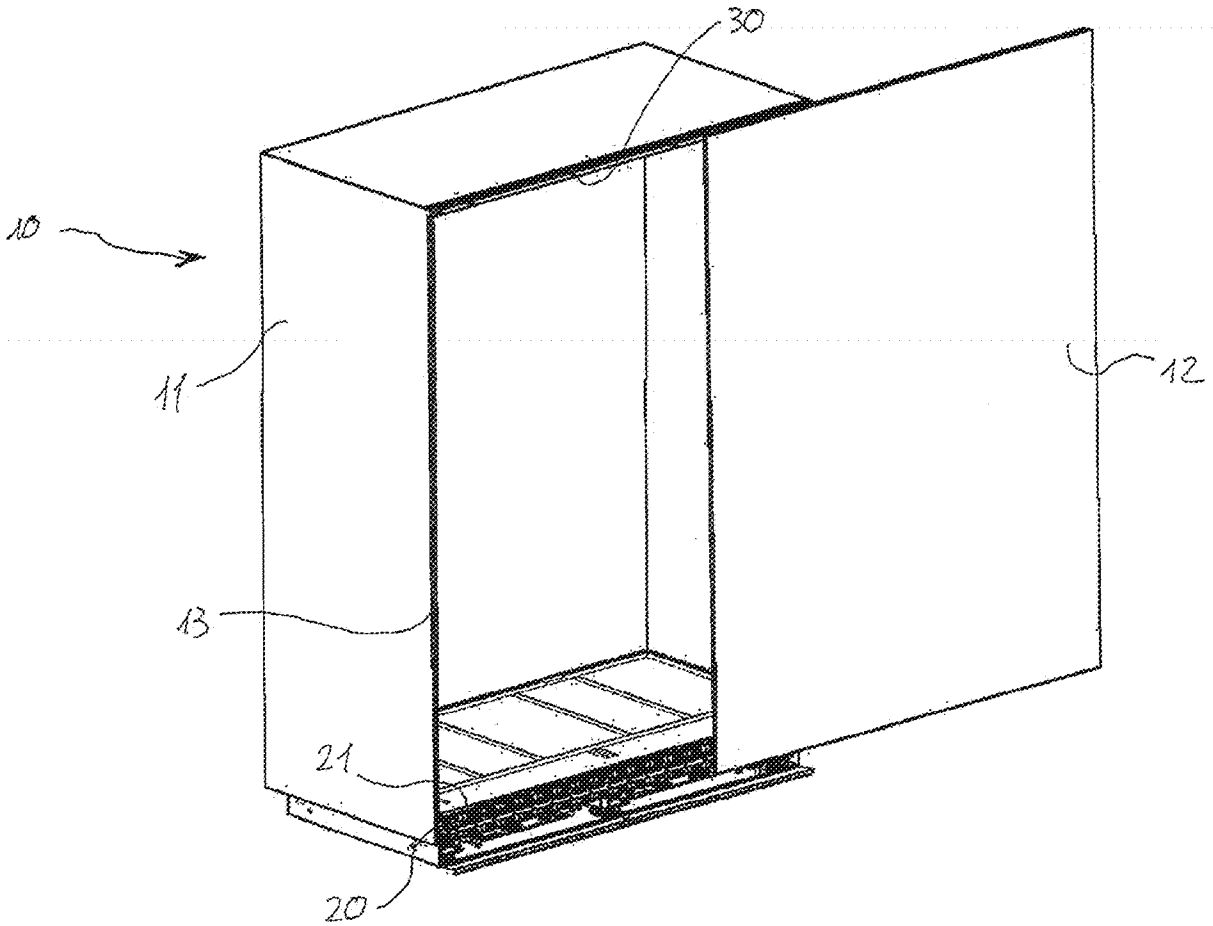
Figure 4:
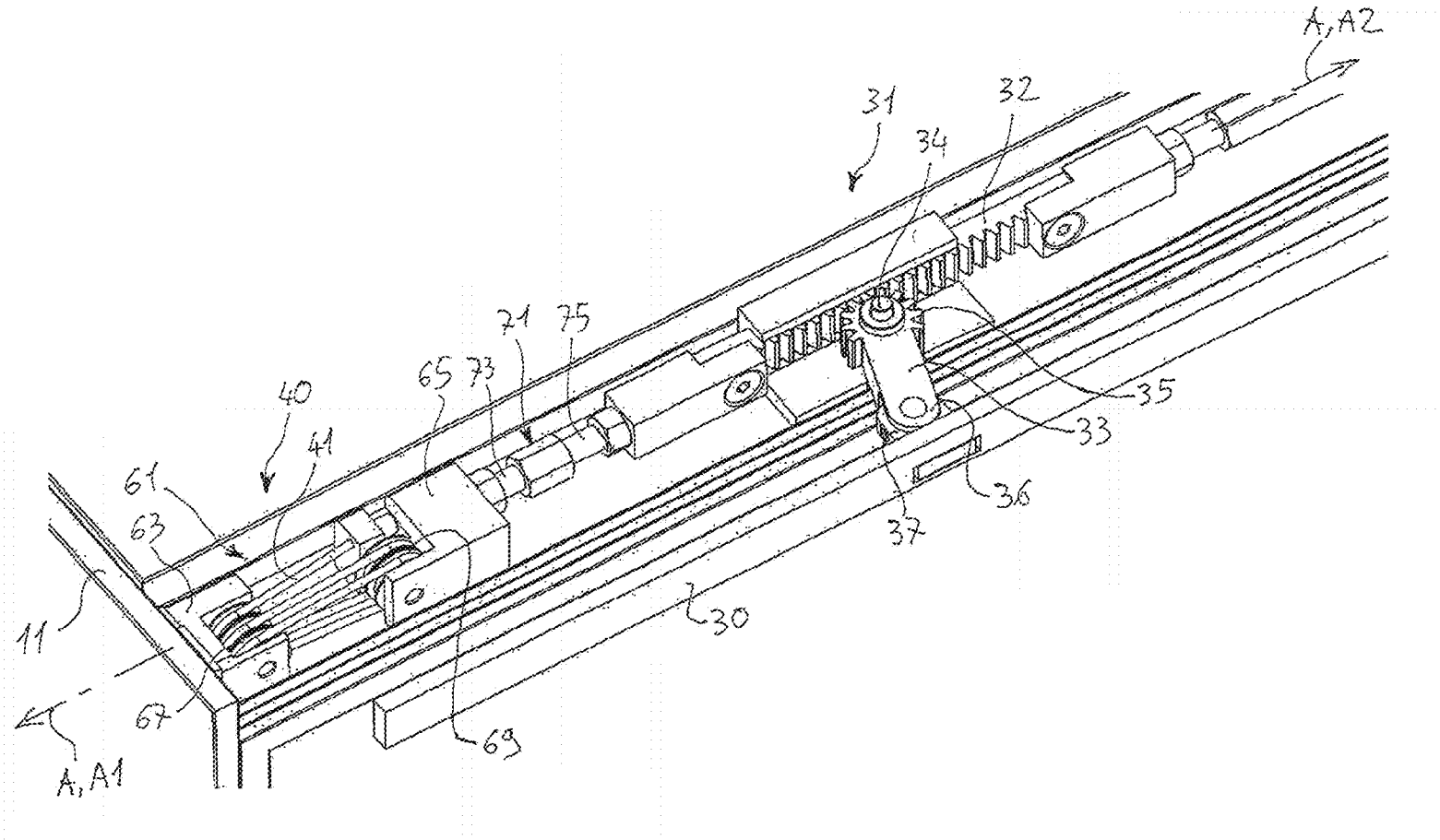
FIG. 4 is a schematic view of the left upper part of the showcase of FIGS. 1-3, with parts partially removed.
Figure 5:
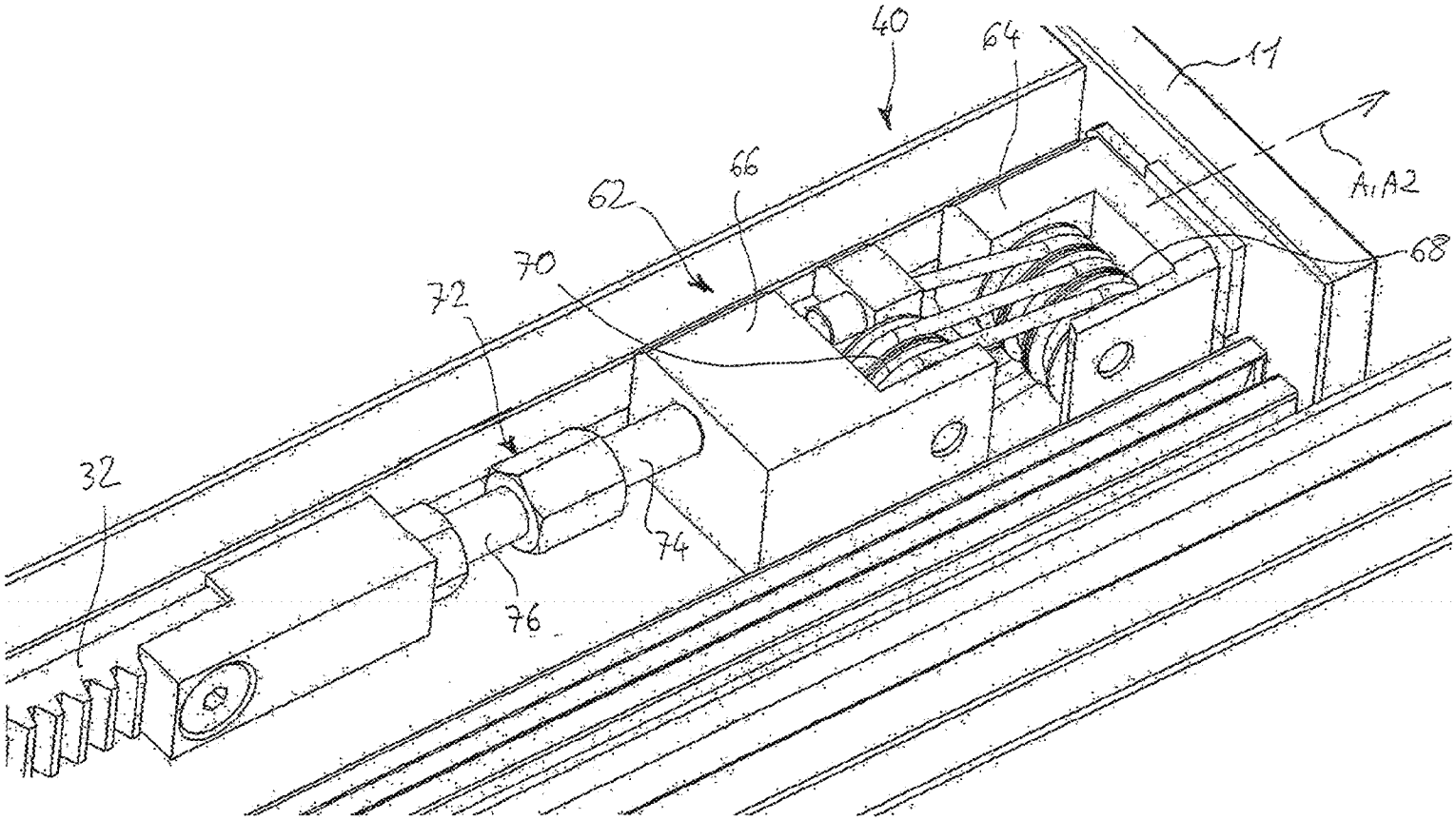
FIG. 5 is a schematic view of the right upper part of the showcase of FIGS. 1-3, with parts partially removed.
Figure 6:
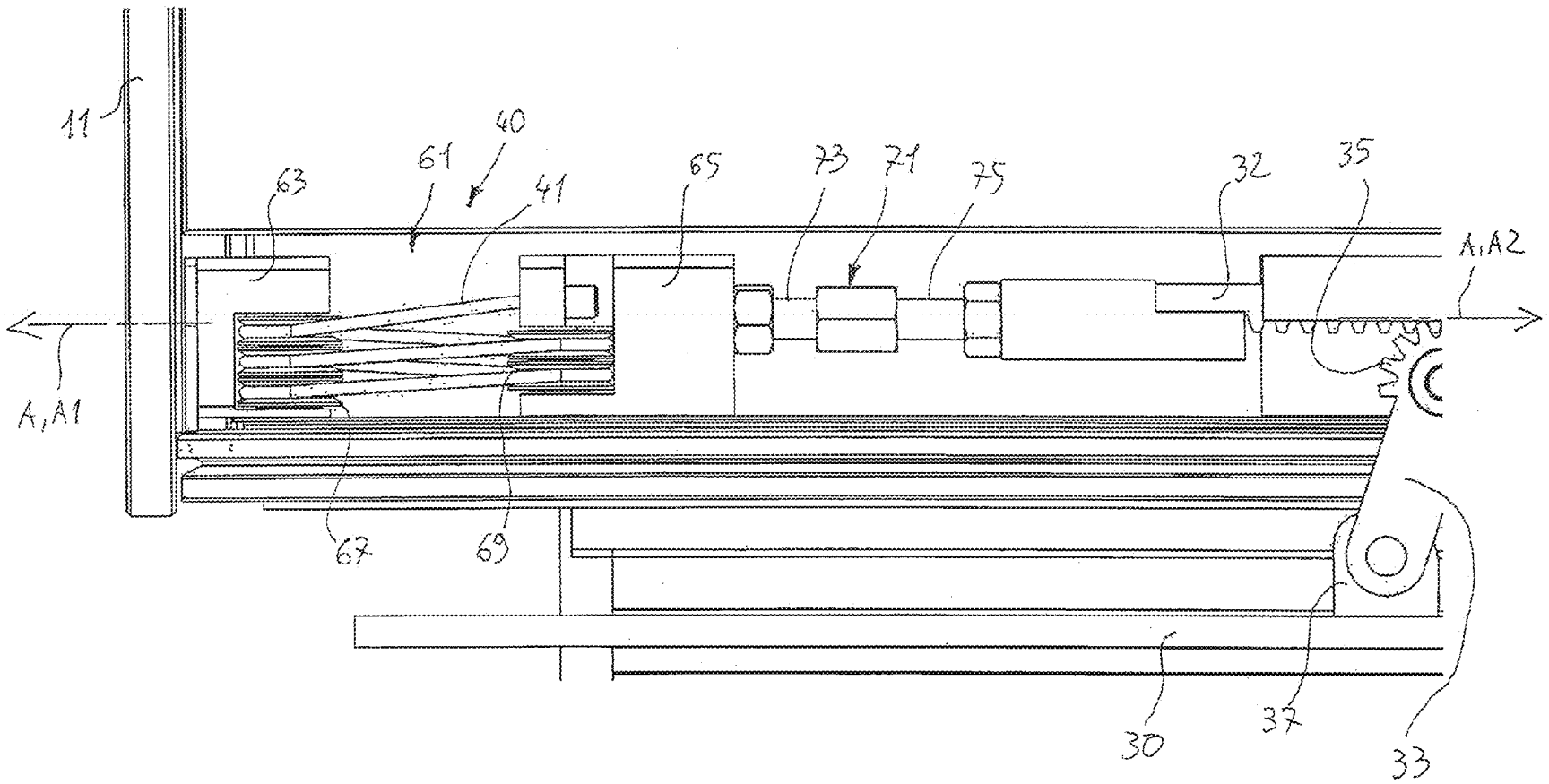
FIG. 6 is a schematic view from above of the left upper part of the showcase of FIGS. 1-3, with parts partially removed.
Figure 7:
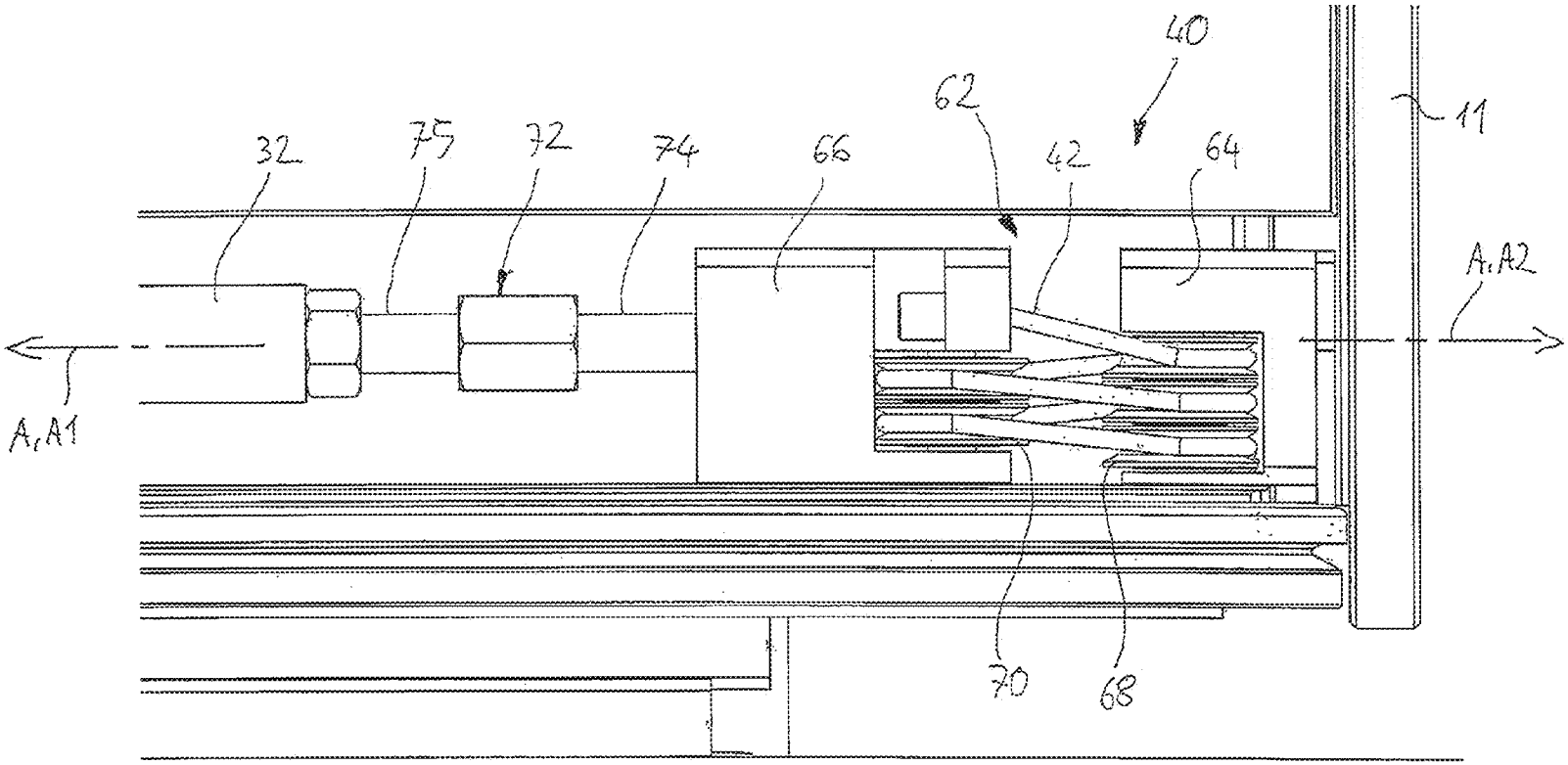
FIG. 7 is a schematic view from above of the right upper part of the showcase of FIGS. 1-3, with parts partially removed.
Figure 8:
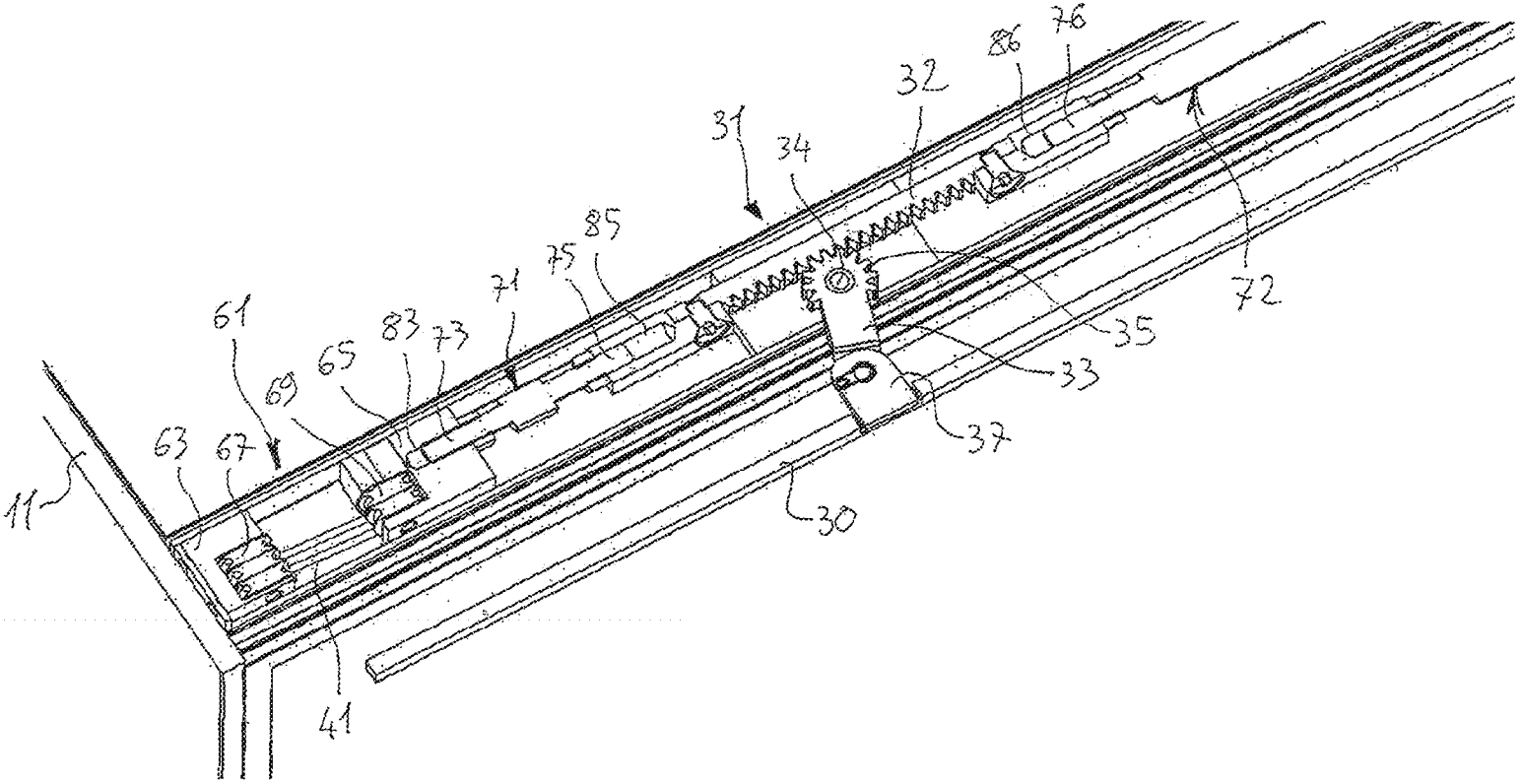
FIG. 8 is a schematic view from above of the left upper part of the showcase of FIGS. 1-3, with parts partially sectioned in a horizontal plane.
Figure 9:
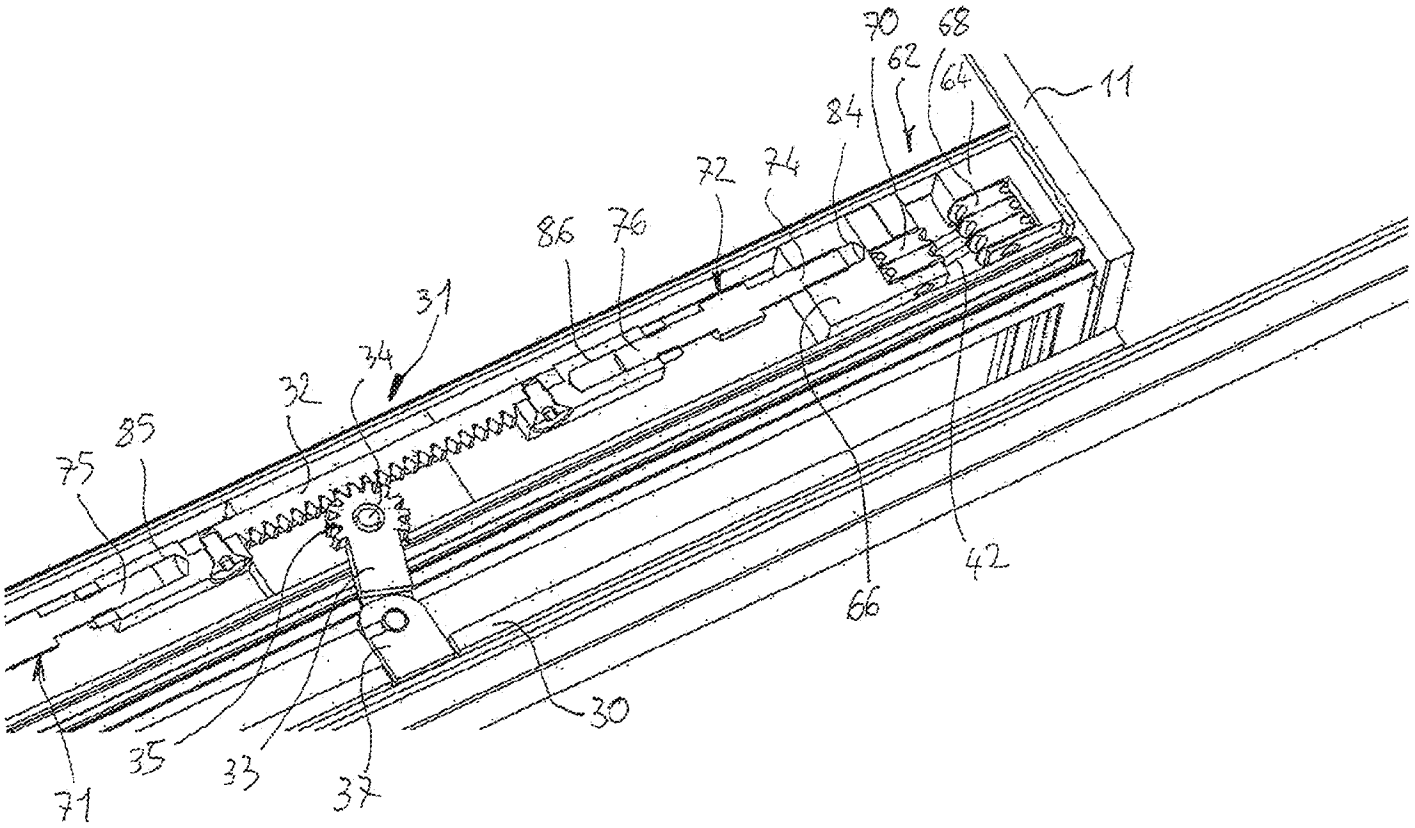
FIG. 9 is a schematic view from above of the right upper part of the showcase of FIGS. 1-3, with parts partially sectioned in a horizontal plane.

In FIGS. 1-11, reference numeral 10 wholly indicates a showcase with sliding opening, i.e. provided with a fixed case 11 and with an openable door 12 that can take up three operative positions, shown in FIGS. 1-3: a position with the door 12 closed (FIG. 1), in which the door 12 is forced against the fixed case 11, with interposition of a sealing gasket 13, elastically deformed by compression; a position with the door 12 open and semi-shut (FIG. 2), in which the door 12 is distanced from the fixed case 11, whilst still being in front of it, so that the gasket 13 is no longer compressed but access to the inside of the case is obstructed by the door 12 itself; a position with the door 12 open and distanced (FIG. 3), in which the door 12 is away from the fixed case 11 and access to the inside of the fixed case 11 is totally free.

In order to be able to move between these three operative positions, the door 12 is mounted on a lower guide 20 and an upper guide 30, both mounted movable towards/away from the fixed case 11 of the showcase 10, between respective extracted positions and respective retracted positions with respect to the case 11. For this purpose, the showcase 10 is provided with lower actuation means, adapted to move the lower guide 20 from the extracted position to the retracted position and vice versa, and with upper actuation means, adapted to move the upper guide 30 from the extracted position to the retracted position and vice versa.

Figure 10:
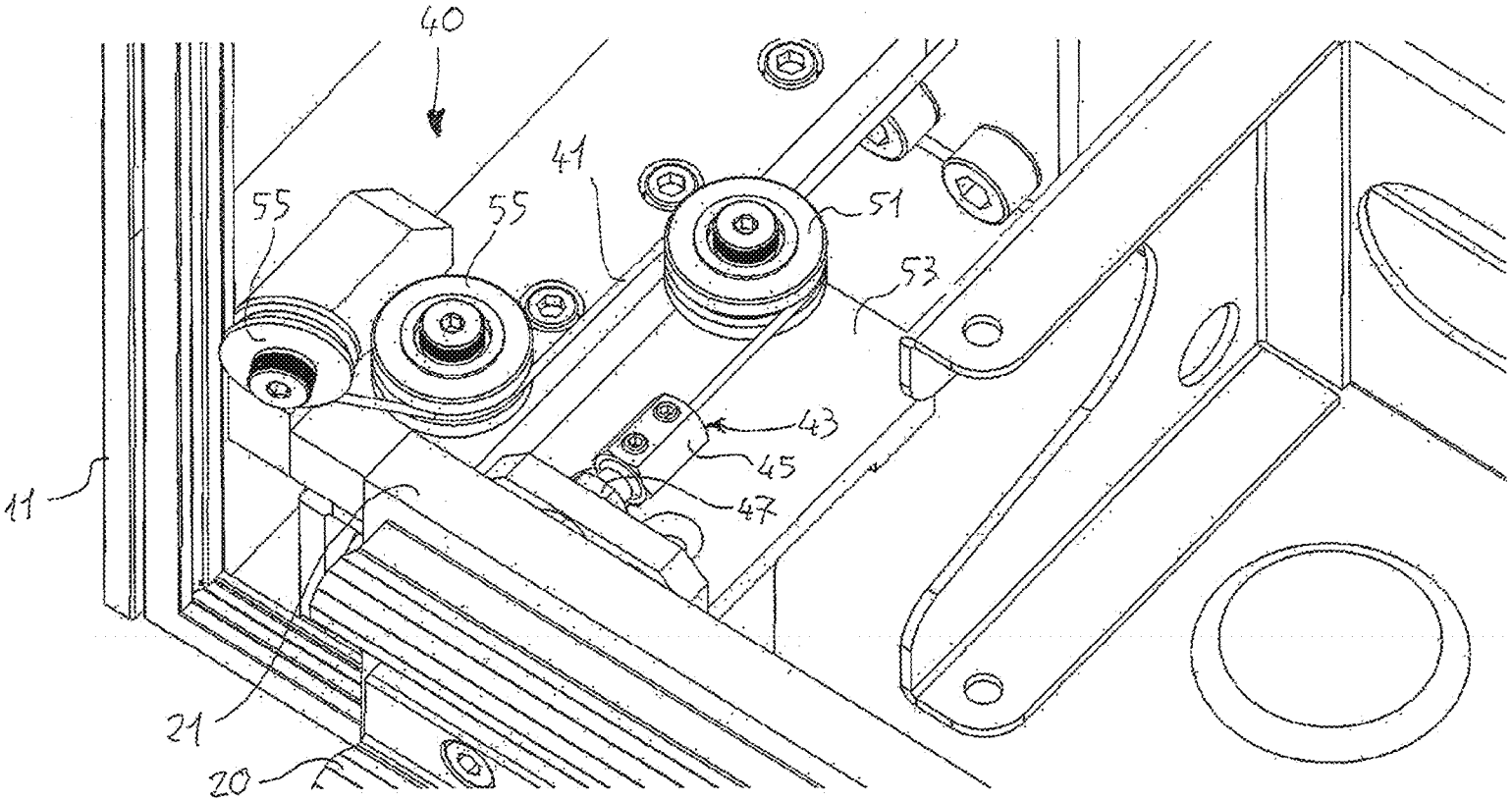
FIG. 10 is a schematic view of the left lower part of the showcase of FIGS. 1-3, with parts partially removed.
Figure 11:
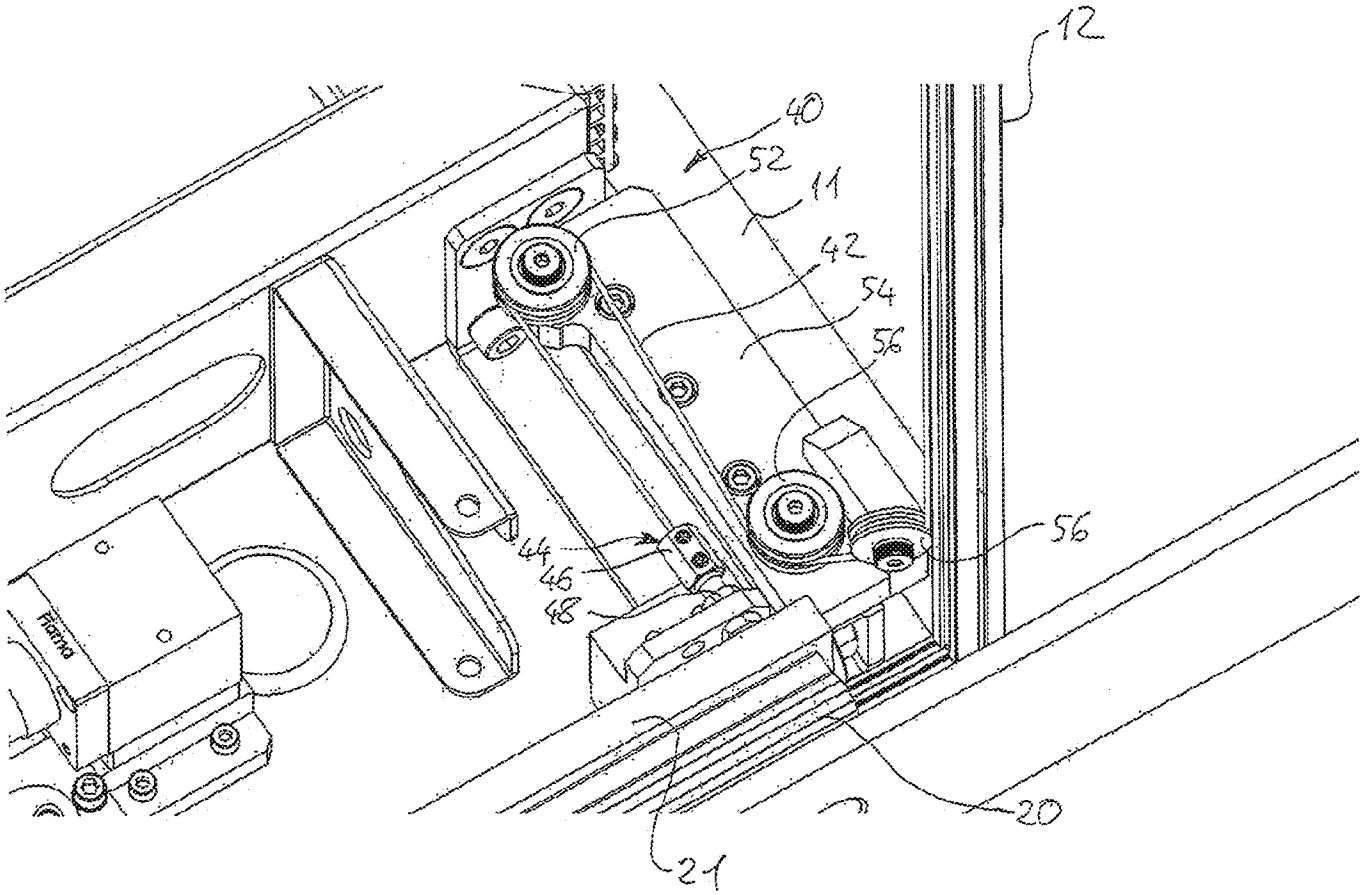
FIG. 11 is a schematic view of the right lower part of the showcase of FIGS. 1-3, with parts partially removed.

The lower actuation means can be of any known type, either manual or motorised, according to the specific requirements; the specific characteristics of these lower actuation means do not form part of the present invention and therefore are not described or illustrated in detail. In FIGS. 3, 10, 11, a bar 21 of the lower actuation means can be seen, extending along the lower edge of the openable side of the showcase 10 where the door 12 is located.

The upper actuation means comprise one or more actuation groups 31, each of which comprises a rack 32, slidably mounted on the case 11 along an axis A, at an upper side thereof; an arm 33 is hinged to the case 11 through a pin 34 orthogonal to the rack 32 and is provided on one side with a toothed section 35, formed on the arm 33 about the pin 34, and on the other side with an end 36, hinged to an arm 37 integral with the upper guide 30. The toothed section 35 is meshed with the rack 32 and therefore a sliding of the rack 32 along the axis A, in the two opposite directions A1 and A2, causes a rotation of the arm 33 and therefore a movement of the arm 37 that moves the upper guide 30: when the rack 32 is moved in the direction A1 (to the left, in the figures), the upper guide 30 is moved towards its extracted position, vice versa when the rack 32 is moved in the direction A2 (to the right, in the figures), the upper guide 30 is moved towards its retracted position.

The showcase 10 also comprises a mechanical transmission 40, through which the groups 31 of the upper actuation means are operatively connected to the lower guide 20, so as to move the upper guide 30 into its extracted position when the lower guide 20 is moved into its extracted position and to move the upper guide 30 into its retracted position when the lower guide 20 is moved into its retracted position.

The mechanical transmission 40 comprises a first cable 41 and an opposite second cable 42, connected between the lower guide 20 and the rack 32.

More specifically, the cable 41 is equipped at one end thereof with a head 43, with which the cable 41 is anchored to the bar 21 and through this to the lower guide 20. The head 43 is adjustable in length, being formed from two portions 45 and 47 in screwing engagement with each other; the portions 45 is fixed to the end of the cable 41, whereas the portion 47 is fixed to the bar 21. Similarly, the cable 42 is equipped at one end thereof with a head 44, with which the cable 42 is anchored to the bar 21 and through this to the lower guide 20. The head 44 is adjustable in length, being formed from two portions 46 and 48 in screwing engagement with each other; the portion 46 is fixed to the end of the cable 42, whereas the portion 48 is fixed to the bar 21.

The first cable 41 is guided in the showcase 10 by first return means, in the form of pulleys, which comprise a first initial return means 51, hinged on a bracket 53 integral with the case 11, and first successive return means 55, hinged on the case 11. Similarly, the second cable 42 is guided into the showcase 10 by second return means, in the form of pulleys, which comprise a first initial return means 52, hinged on a bracket 54 integral with the bar 21, and first successive return means 56, hinged on the case 11.

The connection of the first cable 41 to the rack 32 takes place through a hoist 61, formed from a fixed body 63 fixed to the case 11, a movable body 65 fixed to the rack 32 and slidably guided on the case 11 in the direction A, and two series 67 and 69 of pulleys, mounted idly on the fixed body 63 and on the movable body 65, respectively; there are three pulleys 67, whereas there are two pulleys 69. The first cable 41, guided by the first successive return means 55, reaches the hoist 61 and passes alternately in the pulleys 67 and 69; the first cable 41 is finally anchored at its end to the movable body 65.

Similarly, the connection of the second cable 42 to the rack 32 takes place through a hoist 62, formed from a fixed body 64 fixed to the case 11, a movable body 66 fixed to the rack 32 and slidably guided on the case 11 in the direction A, and two series 68 and 70 of pulleys, idly mounted respectively on the fixed body 64 and on the movable body 66; there are three pulleys 68, whereas there are two pulleys 70. The second cable 42, guided by the first successive return means 56, reaches the hoist 62 and passes alternately in the pulleys 68 and 70; the second cable 42 is finally anchored at its end to the movable body 66.

In this way, when the lower guide 20 is moved from the retracted position to the extracted position, the first cable 41 is placed under traction and thus pulls the rack 32 making it translate in the first direction A1. The hoist 61 ensures that the first cable 41 applies on the rack 32 a force multiplied by as many times as there are passages through the pulleys 67, 69, with an inverse reduction in displacement; in this case, with five passages between the pulleys, the force multiplication is equal to 5 and the reduction in displacement is equal to 1:5. The movement of the rack 32 ensures that the arm 33 rotates and thus moves the upper guide 30 from the retracted position to the extracted position. At the same time, the movement of the lower guide 20 ensures that the second cable 42 is released by a length exactly equal to that by which the first cable 41 is pulled; the hoist 62 then carries out the same reduction in displacement of the hoist 61 and therefore the second cable 42 does not pull the rack 32 in the second direction A2 but follows the movement thereof in the first direction A1.

When, on the other hand, the lower guide 20 is moved from the extracted position to the retracted position, the second cable 42 is placed under traction and thus pulls the rack 32 making it translate in the second direction A2. The hoist 62 ensures that the second cable 42 applies on the rack 32 a force multiplied by as many times as there are passages through the pulleys 68, 70, with an inverse reduction in displacement; in this case, with five passages between the pulleys, the force multiplication is equal to 5 and the reduction in displacement is equal to 1:5. The movement of the rack 32 ensures that the arm 33 rotates and thus moves the upper guide 30 from the extracted position to the retracted position. At the same time, the movement of the lower guide 20 ensures that the first cable 41 is released by a length exactly equal to that by which the second cable 42 is pulled; the hoist 61 then carries out the same reduction in displacement of the hoist 62 and therefore the first cable 41 does not pull the rack 32 in the first direction A1 but follows the displacement thereof in the second direction A2.

The number of pulleys 67, 69 and 68, 70 of the hoists 61 and 62 can be different, to obtain different movement reduction ratios; the preferred reduction ratios are comprised between 1:2 and 1:8. However, it is important for the two hoists 61 and 62 to make the same reduction ratio, to maintain the perfect synchrony of movement between the two cables 41 and 42, without having to make use of corrective provisions.

The fastening between the rack 32 and the movable body 65 of the first hoist 61 is made in an adjustable manner, thanks to a threaded tie-rod 71, more precisely provided with two threadings 73, 75 in opposite directions, engaged in corresponding threaded holes 83, 85 formed in the movable body 65 and in the rack 32. Similarly, the fastening between the rack 32 and the movable body 66 of the second hoist 62 is carried out in an adjustable manner, thanks to a threaded tie-rod 72, more precisely provided with two threadings 74, 76 in opposite directions, engaged in corresponding threaded holes 84, 86 formed in the movable body 66 and in the rack 32. By adjusting the tie-rods 71 and 72 it is possible to precisely adjust the position of the rack 32 along the axis A; the tension of the cables 41 and 42, on the other hand, is adjusted by acting on the adjustable heads 43 and 44.

The operation of the showcase 10 according to the invention is clear from the above description of its structure.

In particular, it can be understood how it is possible to simultaneously and synchronously actuate the upper and lower guides 30, 20 of the showcase 10 to slide, by only acting on the lower guide 20, thus without the operator needing to gain access to the upper area of the showcase 10. This advantage is very important when the showcase 10 is of substantial height, such that the operator cannot access its upper part without using ladders or similar, and when the sealing requirements necessitate a strong compression of the gasket 13. The cable transmission system 41, 42, in particular if with the hoists 61, 62, indeed makes it possible to actuate the upper guide 30 with force, such as to be able to exert the necessary compression force on the gasket 13.

Figure 12:
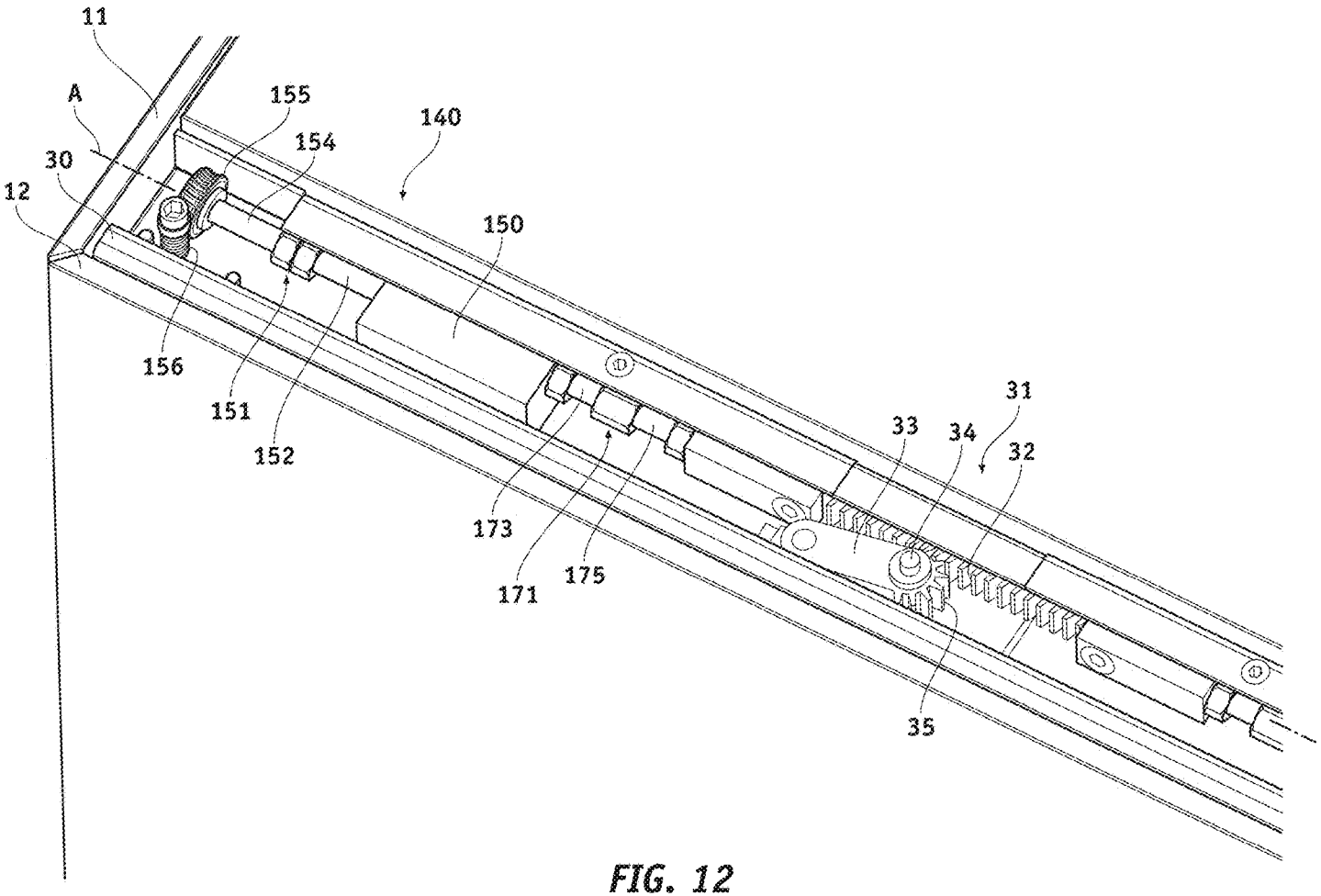
FIG. 12 is a schematic view of the left upper part of a showcase according to a different embodiment of the invention.
Figure 13:
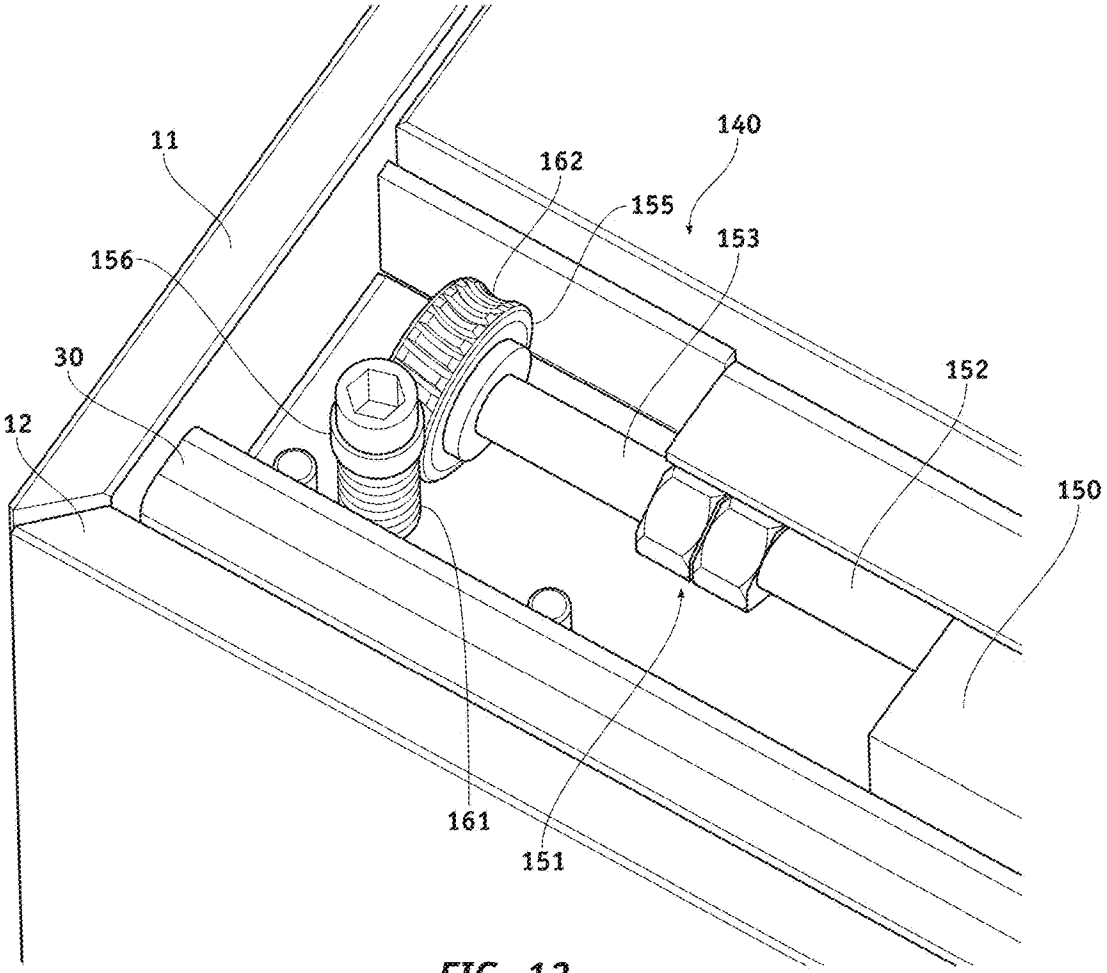
FIG. 13 is an enlarged view of the left upper part of the showcase of FIG. 12.
Figure 14:
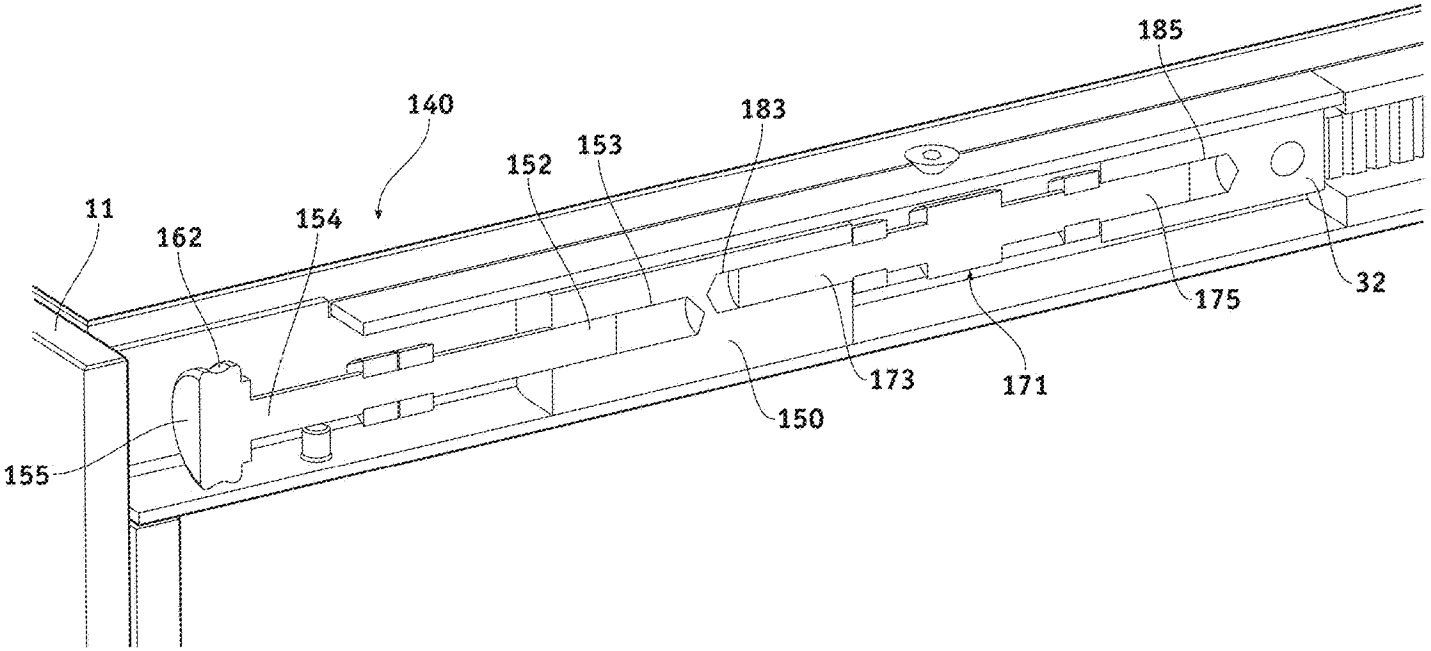
FIG. 14 is a schematic perspective view, partially in section, of the left upper part of the showcase of FIG. 12.

FIGS. 12-14 show a variant of mechanical transmission 140 for the movement of the rack 32; only the characteristics of this variant that differentiate it from what has already been described and illustrated in FIGS. 1-11 will be described, while the characteristics that are the same will not be described and the same reference numerals will be used for them.

In this variant, the transmission 140 comprises a body 150, able to slide along the direction A and associated with the rack 32; a tie-rod 151 is provided with a threaded traction portion 152, mounted engaged in a corresponding threaded cavity 153 of the sliding body 150 and with a control portion 154 provided with a wheel 155, fastened integral in rotation with the tie-rod 151. A motor axis 156 is also provided, adjacent to the wheel 155; the motor axis 156 and the wheel 155 are provided with respective toothings 161 and 162 engaged with each other, which make a screw-nut coupling between them.

The motor axis 156 extends vertically in the showcase 10 and can be made accessible by external driving means, in a lower area of the showcase (not visible in the figures). Alternatively, the motor axis 156 can be set in rotation by the lower actuation means 20.

The fastening between the rack 32 and the sliding body 150 is adjustable, thanks to a threaded tie-rod 171 analogous to the tie-rod 71, i.e. provided with two threadings 173, 175 in opposite directions, engaged in corresponding threaded holes 183, 185 formed in the sliding body 150 and in the rack 32.

The operation of this variant of a mechanical transmission using a screw and nut is mostly analogous to what has already been described for the variant using cables. Differently, this variant allows the rack 32 to be irreversibly controlled; the screw-nut coupling, indeed, allows motion to be transferred from the screw (motor axis 156) to the nut (wheel 155) but not vice versa, thus safely avoiding any accidental movement of the rack. The transmission ratio between screw and nut is selected so as to directly obtain the necessary reduction in motion, without using hoists or other mechanical reductions.

The invention claimed is:

1. A showcase for storage and display of objects in a protected environment, comprising:

a fixed case, an openable sliding door, closable on the fixed case, a compression sealing gasket, between the fixed case and the openable door, an upper guide and a lower guide mounted on the fixed case, wherein the openable door is mounted slidable on the upper and lower guides, and both the upper guide and the lower guide are movable between respective extracted positions and respective retracted positions with respect to the fixed case, lower actuation means, adapted to move the lower guide from the extracted position to the retracted position and vice versa, and upper actuation means, adapted to move the upper guide from the extracted position to the retracted position and vice versa, wherein the upper actuation means are adapted to be actuated without accessing any upper area of the showcase, wherein the upper actuation means are operatively connected to the lower actuation means and/or to the lower guide, so as to move the upper guide to the extracted position thereof when the lower guide is moved to the extracted position thereof and move the upper guide to the retracted position thereof when the lower guide is moved to the retracted position thereof.

2. The showcase according to claim 1, wherein the upper actuation means comprise at least one actuation group comprising:

a rack, slidably mounted on the case alongside an upper side thereof, an arm hinged to the case through a pin orthogonal to the rack, a toothed section, formed on the arm around the pin and meshed with the rack, and an end of the arm, remote with respect to the toothed section, hinged to an arm integral with the upper guide.

3. The showcase according to claim 2, wherein the mechanical transmission comprises:

a slidable body associated to the rack, a tie-rod, with a threaded traction portion engaged at a corresponding threaded cavity of the slidable body and a control portion provided with a wheel, fastened integral in rotation with the tie-rod, a motor axis, adjacent to the wheel, and a screw-nut coupling between the driving axis and the wheel.

4. The showcase according to claim 3, wherein the driving axis extends vertically in the showcase and it is accessible by external driving means, in a lower area of the showcase.

5. The showcase according to claim 3, wherein the driving axis extends vertically in the showcase and it is rotatably driven by the lower actuation means.

6. The showcase according to claim 3, wherein the fastening between the rack and the slidable body is adjustable.

7. The showcase according to claim 1, wherein the upper actuation means are operatively connected to the lower actuation means and/or to the lower guide through a mechanical transmission.

8. The showcase according to claim 7, wherein the upper actuation means comprise at least one actuation group comprising:

a rack, slidably mounted on the case alongside an upper side thereof, an arm hinged to the case through a pin orthogonal to the rack, a toothed section, formed on the arm around the pin and meshed with the rack, and an end of the arm, remote with respect to the toothed section, hinged to an arm integral with the upper guide; and wherein the mechanical transmission comprises a first cable, connected between the lower actuation means and the rack of the upper actuation means, adapted to pull the rack in a first direction.

9. The showcase according to claim 8, wherein the mechanical transmission comprises a second cable, connected between the lower actuation means and the rack of the upper actuation means, opposite to the first cable, adapted to pull the rack in a second direction opposite to the first direction.

10. The showcase according to claim 9, wherein the mechanical transmission comprises a plurality of return means for the first and the second cable, wherein the arrangement of the return means is such that:

when the lower guide is moved from the retracted to the extracted position, the first cable pulls the rack translating it in the first direction, moving the arm so as to move the upper guide from the retracted position to the extracted position, while the second cable does not pull the rack in the second direction but follows the displacement thereof in the first direction;

when the lower guide is moved from the extracted position to the retracted position, the second cable pulls the rack translating it in the second direction, moving the arm so as to move the upper guide from the extracted position to the retracted position, while the first cable does not pull the rack in the first direction but follows the displacement thereof in the second direction.

11. The showcase according to claim 10, wherein:

the first cable is anchored to the lower guide and the return means on which the first cable passes comprise a first initial return means hinged on a bracket integral with the case and a plurality of first successive return means hinged on the case;

the second cable is anchored to the lower guide and the return means on which the second cable passes comprise a second initial return means hinged on a bracket integral with the lower guide and a plurality of second successive return means hinged on the case.

12. The showcase according to claim 11, wherein the anchoring between the first cable and the lower guide and the anchoring between the second cable and the lower guide are adjustable.

13. The showcase according to claim 9, wherein the first cable passes in a first hoist, the first hoist comprising a fixed body and a movable body, wherein;

the fixed body is fastened to the case, the movable body is fastened to the rack and it is slidably guided on the case together with the rack, and on the fixed and movable bodies, two respective series of pulleys are rotatably mounted, on which the first cable passes;

the second cable passes in a second hoist, the second hoist comprising a fixed body and a movable body, wherein the fixed body is fastened on the case, the movable body is fastened to the rack and it is slidably guided on the case together with the rack, and on the fixed and movable bodies two respective series of pulleys are rotatably mounted, on which the second cable passes;

wherein the first and the second hoists have the same number of pulleys so as to obtain the same ratio.

14. The showcase according to claim 13, wherein the ratio of the first and the second hoist is comprised between 1:2 and 1:8.

15. The showcase according to claim 13, wherein fastening between the rack and the movable bodies of the first and the second hoist is adjustable.

16. A showcase for storage and display of objects in a protected environment, comprising:

a fixed case, an openable sliding door, closable on the fixed case, a compression sealing gasket, between the fixed case and the openable door, an upper guide and a lower guide mounted on the fixed case, wherein the openable door is mounted slidable on the upper and lower guides, and both the upper guide and the lower guide are movable between respective extracted positions and respective retracted positions with respect to the fixed case, lower actuation means, adapted to move the lower guide from the extracted position to the retracted position and vice versa, and upper actuation means, adapted to move the upper guide from the extracted position to the retracted position and vice versa, wherein the upper actuation means are adapted to be actuated without accessing any upper area of the showcase, wherein the upper actuation means comprise at least one actuation group comprising:

a rack, slidably mounted on the case alongside an upper side thereof;

an arm hinged to the case through a pin orthogonal to the rack;

a toothed section, formed on the arm around the pin and meshed with the rack; and an end of the arm, remote with respect to the toothed section, hinged to an arm integral with the upper guide.

* * * * *